US005693370A

United States Patent [19]

Van den Zegel

[11] Patent Number: 5,693,370

[45] Date of Patent: Dec. 2, 1997

[54] METHOD OF MANUFACTURING A SILVER HALIDE PHOTOGRAPHIC SILVER HALIDE MATERIAL SUITABLE FOR RAPID PROCESSING APPLICATIONS

[75] Inventor: Marc Van den Zegel, Boortmeerbeek, Belgium

[73] Assignee: Agfa-Gevaert, N.V., Mortsel, Belgium

[21] Appl. No.: 671,235

[22] Filed: Jun. 27, 1996

[30] Foreign Application Priority Data

Jul. 4, 1995 [EP] European Pat. Off. ..... 95201822

[51] Int. Cl.[6] ..... G03C 1/815; G03C 1/825; B05D 1/36

[52] U.S. Cl. ..... 427/414; 427/160; 427/412.4; 427/412.5; 427/420; 430/507; 430/510; 430/513; 430/517

[58] Field of Search ..... 427/414, 420, 427/419.1, 419.8, 412.4, 412.5, 160; 430/502, 507, 510, 513, 517, 966

[56] References Cited

U.S. PATENT DOCUMENTS

| | | | |
|---|---|---|---|
| H1003 | 12/1991 | Ishiwata et al. | 427/414 |
| 3,681,127 | 8/1972 | Fowler, Jr. et al. | 427/414 |
| 3,988,157 | 10/1976 | Van Paesschen et al. | 427/414 |
| 4,900,652 | 2/1990 | Dickerson et al. | 430/507 |
| 5,077,184 | 12/1991 | Hattori et al. | 430/510 |
| 5,188,931 | 2/1993 | Marinelli et al. | 427/414 |
| 5,310,637 | 5/1994 | Kurz et al. | 427/414 |
| 5,380,634 | 1/1995 | Kiekens et al. | 430/507 |
| 5,561,038 | 10/1996 | Goan | 430/502 |

*Primary Examiner*—Diana Dudash
*Attorney, Agent, or Firm*—Breiner & Breiner

[57] ABSTRACT

A method is described to provide a radiographic silver halide material by coating on at least one side of a support, covered with a hydrophobic subbing layer comprising as a latex copolymer vinylidene chloride, methylacrylate and itaconic acid, following hydrophilic layers: at least one gelatinous dye containing layer comprising one or more dyes, at least one silver halide emulsion layer, at least one protective antistress layer, and optionally an afterlayer, characterized in that said hydrophilic layers have a swelling ratio of not more than 200% and in that said hydrophilic layers are coated simultaneously by the slide-hopper coating or by the slide-hopper curtain coating technique.

8 Claims, No Drawings

METHOD OF MANUFACTURING A SILVER HALIDE PHOTOGRAPHIC SILVER HALIDE MATERIAL SUITABLE FOR RAPID PROCESSING APPLICATIONS

DESCRIPTION 1. Field of the Invention

This invention relates to a method of manufacturing a silver halide photographic material suitable for rapid processing applications.

2. Background of the Invention

In U.S. Pat. No. 4,900,652 a radiographic element is disclosed which exhibits a high covering power, a reduced cross-over without emulsion desensitization, a reduced wet pressure sensitivity and rapid processing applicablity in a total processing time of less than 90 seconds. The radiographic element is comprised of tabular grain emulsion layers on opposite sites of a transparent film support and a hydrophilic colloid layer comprising dye particles is interposed between the emulsion layer and the support to reduce cross-over. In the processing the said dye particles are completely decolorized. Amounts of hydrophilic colloid coated on both sides of the support are in the range from 3.5 to 6.5 g/m$^2$; and in the interposed layer at least 1 g/m$^2$ is coated. This coated amount of 1 g/m$^2$ is necessary to avoid coating uneveness.

However to get the radiographic image completely dry in a processing cycle of less then 90 seconds, after processing the element in a developer and/or fixer without hardening agents, it is preferred to reduce the amount of gelatin coated per m$^2$. Especially in the antihalation layer containing the dye(s) the amount of gelatin should be reduced to a minimum, without decreasing the amount of dye(s) as the said amount is reducing the cross-over percentage of the radiographic material.

In U.S. Pat. No. 5,077,184 a silver halide photographic material is described, comprising a dye containing hydrophilic antihalation layer wherein the coating weight of the hydrophilic colloid is not more than 0.5 g/m$^2$ and the swelling ratio not higher then 180%. It is stated therein that when this antihalation layer is coated on a subbing layer containing a hydrophobic polymer and dried after coating, then the material built up further adjacent to the said antihalation layer with an emulsion layer and a protective antistress layer, shows the presence of a disturbing residual color, also called "dye stain", after processing. To overcome this problem, it is proposed to coat a thin hydrophilic gelatinous interlayer separately between the said subbing layer and the dye-containing layer, which is not required in e.g. EP-A 0 658 805, although the objects of the invention are quite analogous.

However the coating procedure described in U.S. Pat. No. 5,077,184 is time consuming due to intermediate drying steps, but apart from that the layer arrangement becomes rather complicated and a problem of adhesion between the subbing layer and the adjacent hydrophilic layers can occur after processing a material manufactured by the said coating procedure, especially when a hydrophobic subbing layer, comprises as a latex copolymer vinylidene chloride, methylacrylate and itaconic acid and, to a larger extent, when said material has been hardened with a vinyl sulphonyl hardener.

OBJECTS OF THE INVENTION

Therefor it is a primary object of this invention to provide a method of manufacturing a forehardened radiographic material, comprising a support provided with a subbing layer comprising vinylidene chloride and a dye containing layer in contact with said subbing layer in order to enhance sharpness, the said material being suitable for rapid processing applications without leaving residual stain, without drying problems and without posing adhesion problems.

Further objects will become apparent from the description hereinafter.

SUMMARY OF THE INVENTION

A method is described to provide a radiographic silver halide material by coating on at least one side of a support, covered with a hydrophobic subbing layer, comprising as a latex copolymer vinylidene chloride, methylacrylate and itaconic acid, in consecutive order following hydrophilic layers: at least one gelatinous dye containing layer comprising one or more dyes, at least one silver halide emulsion layer, at least one protective antistress layer, and optionally an afterlayer, characterized in that said hydrophilic layers have a swelling ratio of not more than 200% and in that said hydrophilic layers are coated simultaneously by the slide-hopper coating or by the slide-hopper curtain coating technique.

DETAILED DESCRIPTION OF THIS INVENTION

The method according to our invention shows many advantages over the method applied in the manufacturing of the material, described in U.S. Pat. No. 5,077,184.

First there is no need to build up a more complicated layer arrangement in different coating steps: a solution can be found by coating a layer arrangement comprising at one or both sides of a support, covered with a hydrophobic subbing layer, a hydrophilic layer arrangement consisting of a gelatinous dye containing layer comprising at least one dye, at least one silver halide emulsion layer, at least one protective antistress layer, and, optionally, comprising an afterlayer. No further gelatinous interlayer is required between the said subbing layer and the said antihalation layer and the omission of the said interlayer is even a must, in a radiographic material manufactured according to the method of this invention, in order to prevent poor adhesion characteristics after processing of the said material between the subbing layer and the adjacent hydrophilic layers. Poor adhesion is further prevented by providing a ratio by weight of dye to gelatin of not more than 1.3.

According to the method of this invention the necessary condition to get excellent adhesion properties after processing for a photographic material having the layer arrangement as described hereinbefore is that the so-called hydrophilic layers are coated simultaneously by the well-known techniques as the slide-hopper technique and the slide-hopper curtain coating technique, which have been described e.g. in EP's 0 051 238; 0 107 818; 0 300 098; DE 3 238 904; JP-A 04 001 635; WO 94/029769 and U.S. Pat. Nos. 4,191,213; 4,313,980; 4,384,015; 4,569,863; 4,877,639; 4,942,068 and 5,264,339, without however being limited thereto.

Subbing layers have been described in e.g. DE 2 747 231; in GB 2,033,598; and in WO's 84/000621 and 87/006723.

The subbing layer applied in the method of this invention consists of the latex copolymer vinylidene chloride (88 wt %), methylacrylate (10 wt %) and itaconic acid (2 wt %); the latex copolymer of methylmethacrylate (47.5 wt %), 1,3-butadiene (47.5 wt %) and itaconic acid (2 wt %); polymethylmethacry-late-particles as a matting agent, and coating aids therefor.

According to the method of this invention the layer adjacent to the subbing layer is a dye containing layer comprising a dispersion of at least one dye. Said dye(s) is(are) selected in such a way as to reach the preferred objects of this invention set forth hereinbefore.

In one embodiment of this invention double side coated X-ray film materials are exposed with light emitting phosphors, wherein the dye containing layers present at both sides of the support and in close contact therewith, reduce the amount of light passing through the said support to the opposite layer and, correspondingly, the so-called cross-over exposure related thereto.

Reduction of scattering of incident exposure light not only depends on the absorption spectrum which should match the emission spectrum of the phosphor particles in the screen(s), brought in close contact with the radiographic film material. The absorption spectrum of the dye(s) depends on the nature of the dye(s), which is further determining the wavelength region in which exposure light absorption occurs, but also on the way in which the dye is dispersed in the binder medium of the antihalation layer, which is decisive for the amount of dye that has to be added to the antihalation coating solution.

Ways in which the dye(s) can be dispersed and the medium wherein they can be dispersed are well-known from literature as e.g. from JP-A's 03 013 937; 03 288 842; 03 100 541, from EP-A 0 554 834 and from U.S. Pat. Nos. 4,092,168 and 5,208,137, without however being limited thereto.

In one embodiment fine solid particle dispersions of dyes are preferred and in another embodiment fine particle dispersions prepared in silica sol, so-called "silica solid particle dispersions", the dispersion of which has been described in e.g. EP-A 0 569 074, are preferred.

The way in which the dye(s) is(are) dispersed, the size of the dispersed dye particles and the dispersing aids are further determining the amount of dye(s) required in the dye containing layer, in order to get sufficient absorption of incident exposure rays and reduction of the scattering effect. Lower amounts of dye(s) coated are further in favour of rapid processing applications as the dye(s) can be removed more quickly in the processing.

Well-known phosphor screens are those emitting blue and ultraviolet light or green light. Correspondingly the dyes should be selected in order to absorb light of the corresponding wavelengths. Especially dyes absorbing green light are preferred as problems relating to sharpness are connected to a larger extend with emitted light of longer wavelenghts than those in the ultraviolet and/or blue wavelength region.

Preferred antihalation dyes for use in the materials prepared by the method of this invention are described e.g. in EP-A 0 586 748, EP-A 0 656 401, in EP-Application No. 94203766 (filed Dec. 27, 1994) and in U.S. Pat. Nos. 5,380,634 and 5,344,749 which are incorporated herein by reference.

Well-known dyes are especially merostyryl and oxonol dyes and for all these dyes, it is clear that these preferred dyes are soluble at a pH value above 8.0 (a fulfilled processing condition) and insoluble at a pH value below 6.0 (a recommended coating condition), and are preferably present in the form of a microprecipitated dispersion in order to avoid residual color or dye stain better after processing. The term "microprecipitated dispersion" refers to the method used to prepare a dispersion of the dye which should be soluble in alkaline medium, due to the presence of alkaline soluble groups. Microprecipitation occurs by controlling acidifying of the said alkaline medium, resulting in precipitation of the dye in "microprecipitated form". The presence of the dyes in the said microprecipitated form is recommended in favour of lowering the required concentration of dyes in the dye containing layer(s). Preferably the amount of dye incorporated in the dye containing layer is optimized in order to get a cross-over lower than 15% and more preferably lower than 10% for double side coated materials. Preferably the total concentration of dyes is not higher than 300 mg/m$^2$ and, more preferably, not more than 150 mg/m$^2$ in order to avoid adhesion problems between the subbing layer and the adjacent dye containing layer. A total amount of hydrophilic binder in the dye containing layer(s) is preferably not more than 750 mg/m$^2$, as the ratio between the ratio by weight of dye to hydrophilic binder should preferably exceed a value of 0.4, but remain lower than 1.3 for adhesion reasons as disclosed hereinbefore.

In a preferred embodiment the said dye containing layer is split up into a first layer, containing e.g. at least one dye, and, adjacent thereto, a second layer, containing e.g. at least one other or the same dye or dye mixture. Preferably in this particular case the amount of dye, present in the first dye containing layer in contact with the subbing layer, is not more than 100 mg/m$^2$, and more preferably not more than 50 mg/m$^2$, which means that for a ratio by weight of dye to hydrophilic binder of more than 0.4, the said binder amount should not exceed 0.125 g/m$^2$ in the hydrophilic layer in contact with the subbing layer in a split up dye containing layer arrangement. Furthermore the dye or mixtures of dyes may be the same or different in both layers.

In a preferred embodiment tabular shaped silver halide crystals are present in the emulsion layer(s). For radiographic applications the main photographic advantages of tabular crystals compared to normal globular grains are a high covering power at high forehardening levels, a high developability and higher sharpness, especially in double side coated spectrally sensitized materials. The thinner the tabular grains the greater these advantages.

In spite of these important advantages, tabular crystals have two important disadvantages: the susceptibility to mechanical stress and the unacceptable reddish-brown colour compaired with the cold-black color shown by more globular grains of the developed silver.

A way to overcome these two disadvantages consists in the use of tabular crystals with an increased thickness, the preparation of which has been described in U.S. Pat. Nos. 4,801,522; 5,028,521 and 5,013,641 making use of ammonia or generate ammonia "in situ".

Other ways to reduce pressure sensitivity and to improve image tone have been described in e.g. JP-A's 63 201 646; 01 090 438; 02 139 539; 04 296 845; in EP-Application No. 94203085 (filed Oct. 24, 1994) and U.S. Pat. No. 4,861,702.

A more convenient way to reach this goal has been described in EP-A's 0 569 075, 0 634 688 and 0 674 215: which are incorporated herein by reference and wherein the favorable developability, known from thin tabular grains is reached. A thickness of the silver bromide or silver bromoiodide emulsion crystals between 0.15 and 0.30 μm is highly preferred therein for crystals having an aspect ratio of at least 2, wherein at least 70% of the total projected area of all the grains are provided by tabular grains.

Silver halide compositions are not restricted to silver bromide and/or silver bromoiodide as has e.g. been shown in EP-Application No. 95200651 (filed Mar. 17, 1995), which is incorporated herein by reference, and wherein it has been shown that with the said tabular silver halide crystals rich in chloride, known for a very good developability and a suitable black image tone, a sufficiently high speed is obtained, even for a thickness of the crystals used therein from 0.08 to 0.20 μm.

Methods to prepare tabular silver halide grains are further known very well from the patent literature. Said methods are related with the commonly used precipitation techniques as e.g. double-jet, triple-jet and single-jet precipitations of silver salt solutions, halide solutions and protective colloid solutions in a reaction vessel under controlled circumstances of pAg, temperature and rate of addition. Commonly in a first step, silver halide nuclei are formed, in a separate vessel or in the reaction vessel, wherein the carefully controlled circumstances wherein they are formed are determining the crystal diameter, thickness and degree of homogeneity after the following neutralization, physical ripening and/or growth step(s).

The tabular silver halide emulsions which can be used in the silver halide emulsion layer(s) from the materials manufactured by the method of this invention can be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions may be sensitized also by means of gold-sulphur ripeners or by means of reductors e.g. tin compounds as described in GB Patent 789,823, amines, hydrazine derivatives, formamidine-sulphinic acids, dialdehyde bisulphite adducts and aromatic sulphinic acid as described in U.S. Pat. No. 4,175,970 and silane compounds. More preferred sensitizing agents, in addition to or replacing sulphur compounds, are selenium and/or tellurium compounds as has been described e.g. in JP-A's 04 016 838; 04 324 855; 04 328 740; 04 330 433; 05 045 769; 06 266 034; in EP-A 0 590 593; 0 619 515:0 622 665; 0 638 840; in WO 93/012460; and in U.S. Pat. Nos. 4,861,703; 5,246,826; 5,273,872; 5,273,874; 5,306,613; 5,342,750 and 5,364,754.

The tabular silver halide emulsions may be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in the already cited Research Disclosures items 17643, 18716, 22534 and 308119 and the recently disclosed item 36544, September 1994. Especially preferred green sensitizer in connection with the present invention are anhydro-5,5'-dichloro-3,3'-bis(n.sulfobutyl)-9-ethyloxacarbocyanine hydroxide and anhydro-5,5'-dichloro-3,3'-bis(n.sulfopropyl)-9-ethyloxacarbo-cyanine hydroxide.

In classical emulsion preparation spectral sensitization traditionally follows the completion of chemical sensitization. However, in connection with tabular grains, it is specifically considered that spectral sensitization may occur simultaneously with or may even precede completely the chemical sensitization step: the chemical sensitization after spectral sensitization is believed to occur at one or more ordered discrete sites of tabular grains. This may also be done with the emulsions of the present invention, wherein the chemical sensitization proceeds in the presence of one or more phenidone and derivatives, a dihydroxy benzene as hydroquinone, resorcinol, catechol and/or a derivative(s) therefrom, one or more stabilizer(s) or antifoggant(s), one or more spectal sensitizer(s) or combinations of said ingredients.

Especially 1-p-carboxyphenyl, 4,4' dimethyl-3-pyrazolidine-1-one is added as a preferred auxiliary agent.

The silver halide emulsion layer(s) in accordance with the present invention or the non-light-sensitive layers adjacent thereto may comprise compounds preventing the formation of fog or stabilising the photographic characteristics during the production or storage of the photographic elements or during the photographic treatment thereof. Many known compounds can be added as fog-inhibiting agent or stabilizer to the silver halide emulsion layer or to other coating layers in water-permeable relationship therewith such as an undercoat or a protective layer. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles(preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-Appl. 75-39537, and GB 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds are the compounds described in the Research Disclosures the items of which are given hereinbefore.

In the hydrophilic layers of the material prepared according the method of this invention conventional lime-treated or acid treated gelatin can be used as a hydrophilic colloid. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, N° 16, page 30 (1966). Before and during the formation of the silver halide grains it is common practice to establish a gelatin concentration of from about 0.05% to 5.0% by weight in the dispersion medium. Additional gelatin is added in a later stage of the emulsion preparation e.g. after washing, to establish optimal coating conditions and/or to establish the required thickness of the coated emulsion layer. Preferably a gelatin/silver halide ratio ranging from 0.3 to 1.0, and more preferably from 0.3 to 0.5 is then obtained.

Gelatin can, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates. Also synthetic clays are very useful as has been shown in EP-A 0 644 455.

A very useful binder, whether used alone or in combination with gelatin or other binders, especially during emulsion preparation, is colloidal silica as is known from EP-B 0 392 092; EP-A's 0 517 961; 0 528 476; 0 649 051; 0 682 287; 0 704 749 and EP- Application No. 95200645 (filed Mar. 17, 1995).

The photographic material can contain several non-light sensitive layers. Besides a hydrophilic protective antistress layer, coated simultaneously with at least one emulsion and at least one antihalation layer, according to the method of this invention, one or more intermediate layers, optionally containing filter or antihalation dyes, are coated.

Suitable light-absorbing dyes used in these intermediate layers are described in e.g. U.S. Pat. Nos. 4,092,168 and 4,311,787, in DE 2,453,217, and in GB Patent 7,907,440. Coated in such an intermediate layer between the emulsion layer(s) and the support there will be a small negligable loss in sensitivity only but in rapid processing conditions discoloration of the filter dye layers may form a problem. Therefor it should be recommended to decrease the thickness of the whole layer arrangement coated, resulting in shorter drying times after washing in the processing cycle. In a preferred embodiment a total amount of gelatin over the whole layer arrangement should not exceed 3.5 $g/m^2$, and more preferably not more than 3.2 $g/m^2$.

The use of intermediate layers situated between emulsion layer(s) and support, reflecting the fluorescent light emitted by the screens, brings a solution to further improve sharpness as the light emitted from the screens by the phosphors incorporated therein is a very important source of light-scattering. In that case the addition of appropriate filter dyes to the screens may be recommended. In the presence in the screens of e.g. green light-emitting phosphors use may be made of specific dyes as MAKROLEX ORANGE G or GG, trademarked products of BAYER AG.

In single-side coated materials, coated with at least one emulsion layer at only one side of the support, one or more backing layers can be provided at the non-light sensitive side of the support of the said material. These layers which may serve as anti-curl layer can contain e.g. matting agents like silica particles, lubricants, antistatic agents, light absorbing dyes, opacifying agents e.g. titanium oxide and the usual ingredients like hardeners and wetting agents.

In an embodiment wherein single-side coated films, especially those used for medical diagnosis where reduction of glare is highly appreciated, it may be useful to add a coarse T-grain emulsion to an intermediate layer between the emulsion layer and the protective antistress coating as described in U.S. Pat. No. 5,041,364, which is presented as an alternative for glare reduction in Kodak Ektascan HN. Another method is described in both EP-A 0 592 882 and DE 3 710 625, wherein chemically unripened coarse globular crystals are mixed together with the finer chemically ripened crystals. As an alternative the said coarse globular crystals may be added to the emulsion layer, situated farthest from the support if more than one emulsion layer is present in the layer arrangement.

Antistatic agents may be present in the afterlayer and/or in the protective antistress layer(s); in the subbing layer and/or in the backing layer(s). Preferred antistatic agents are e.g. polythiophenes, which have been described e.g. in U.S. Pat. Nos. 5,108,885; 5,312,681 and 5,391,472.

As the simultaneously coated hydrophilic layers, being the dye containing layer(s), the emulsion layer(s) and the protective antistress layer(s) have a swelling degree in the processing of not more than 200%, this is indicative for a high degree of hardening.

Said swelling degree is determined by means of the following procedure: a sample of each coated material is incubated at 57° C. and 34% RH for 3 days, whereafter the thickness (a) of the layer assemblage is measured, Thereafter the sample is immersed in distilled water at 21° C. for 3 minutes and the thickness (b) of the swollen layer is measured. The swelling ratio is then calculated as: $(b-a)/a\times100$ (%).

The hydrophilic gelatin binder of the photographic elements can be forehardened with appropriate hardening agents such as those of the epoxide type, those of the ethylenimine type, chromium salts as e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives as e.g. 2,3-dihydroxy-dioxan, active vinyl compounds as e.g. 1,3-vinylsulphonyl-2-propanol, di-(vinylsulphonyl)-methane or ethylene di-(vinyl-sulphone) and vinyl sulphonyl hardeners containing amino and alcohol radicals in order to improve water solubility and afterhardening; 1,3,5-triacryloyl-hexahydro-s-triazine, active halogen compounds as e.g. 2,4-dichloro-6-hydroxy-s-triazine, and mucohalogenic acids as e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

A preferred hardening agent in the method of this invention is formaldehyd. Especially as in the method of this invention wherein the hydrophobic subbing layer comprises a latex copolymer of vinylidene chloride, methylacrylate and itaconic acid formaldehyd hardening is in favour of good adhesion properties.

In a preferred embodiment the hardener is added to the protective antistress layer, just before coating or added to an afterlayer. The said afterlayer may further contain antistatic agents as described e.g. in EP-B 0 300 259 and in EP-A 0 644 456, which is incorporated herein by reference, and may be coated alternatively by means of the spray-coating technique as has e.g. been described in GB 1,334,429 and in WO 92/14188.

The addition of the hardening agent to the protective antistress layer or to the afterlayer can also be performed by means of a dose feeder.

Amounts of hardener are chosen in such a way as to obtain a swelling degree of the hydrophilic layers of not more than 200% as described hereinbefore.

Materials prepared according to this invention are both single-side coated and double-side coated materials. In both cases, dye containing layers are recommended in favour of sharpness: scattering of the exposure light reflecting on the support has to be avoided for single-side coated materials and double-side coated materials and moreover cross-over has to be reduced to a minimum for double-side coated, also called "duplitized" materials. Preferably the materials manufactured by the method of this invention are duplitized materials. For single-side coated materials it is also possible to coat the dye containing layer at the side of the support differing from the side where the emulsion layer(s) is(are) situated.

In X-ray photography a material with a single or a duplitized emulsion layer coated on one or both sides of the support may contain one single emulsion layer, as it is the case for many applications, or it can be built up by two or even more emulsion layers. By using duplitized emulsions differing in photographic speed by at least 0.15 log E a gain in cross-over exposure in double side coated materials can be obtained.

The method used in connection with the present invention can further also be applied to the manufacturing of various other types of photographic elements as e.g. colour sensitive materials, as those described e.g. in EP-A 0 582 000; EP-A No. 95201015 (filed Apr. 21, 1995) and U.S. Pat. No. 4,770,984. In these materials each of the blue, green and red sensitive layers can be single coated, but generally the said layers consist of double or even triple layers.

Besides the light sensitive emulsion layer(s) the photographic material and the several light-insensitive layers as e.g. the protective antistress layer, one or more backing layers (in the case of single-side coated materials), one or more subbing layers, one or more dye containing layers, one or more filter layers can be present on top of the emulsion layer(s). The said filter layer(s) comprising one or more filter dye(s) can be used for safety-light purposes. Even for the more complicated layer arrangement, it is required, according to the method of this invention, to coat these layers simultaneously by means of the slide-hopper or slide-hopper curtain coating technique.

The support of the photographic material may be opaque or transparent e.g. a paper support or resin support. When a paper support is used preference is given to one coated at one or both sides with an Alpha-olefin polymer, e.g. a polyethylene layer. It is also possible to use an organic resin support e.g. cellulose nitrate film, cellulose acetate film, poly(vinyl acetal) film, polystyrene film, poly(ethylene terephthalate) film, poly(ethylene naphthalate) film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material prepared by the method according to the present invention can be image-wise exposed by any convenient radiation source in accordance with its specific application.

Of course processing conditions and composition of processing solutions are dependent from the specific type of photographic material prepared according to the present invention.

For example, in a preferred embodiment of materials for X-ray diagnostic purposes said materials may be adapted to rapid processing conditions. Preferably an automatically operating processing apparatus is used provided with a system for automatic regeneration of the processing solutions. The forehardened material may be processed using one-part package chemistry or three-part package chemistry, depending on the processing application determining the degree of hardening required in said processing cycle. Applications within total processing times from 30 seconds up to 90 seconds, known as common praxis, are possible. From an ecological point of view it is even recommended to use sodium thiosulphate instead of ammonium thiosulphate.

Advantages of this method, taking into the account the restrictions concerning amounts of gelatin and swelling ratio of the hydrophilic layers, coated simultaneously according to the method of this invention, and amounts of dye(s) in the thin hydrophilic antihalation layer(s) are good adhesion characteristics after processing, the absence of unevenness, the absence of pinholes and of residual colour (dye stain), even for high hardening degrees, said hardening degree reflected in low swelling degrees in the processing of these materials of not more than 200% providing good drying characteristics.

The following examples illustrate the invention without however limiting it thereto.

EXAMPLES

Example 1

1.1 Preparation of the Materials.

1.1. Preparation of the Supports 1 to 6.

1.1.1. Support 1

A blue tinted, longitudinally stretched polyethylene terephtalate film support having a thickness of approximately 0.61 mm was subbed on both sides with a coating solution at a coverage of 130 $m^2$ per liter. The layer was dried in a hot air stream whereafter the coated support was stretched transversally to 3.5 times its original width, at a temperature of about 110° C. The final thickness of the film was 175 μm. The film was then heat-set while being kept under tension at a temperature of 220° C. for about 10 seconds. After heat setting the film was cooled. This subbing procedure resulted in the following layer composition per $m^2$ and per side:

- 0.17 g of latex copolymer vinylidene chloride (88 wt %), methylacrylate (10 wt %) and itaconic acid (2 wt %),
- 0.06 g of latex copolymer of methylmethacrylate (47.5 wt %), 1,3-butadiene (47.5 wt %) and itaconic acid (2 wt %),
- 0.001 g polymethylmethacrylate-particles with an average diameter of 3.5 μm as a matting agent,
- 0.003 g Akypo OP 80 (Chemy) and 0.001 g Hostspal BV (Hoechst AG) as coating aids.

1.1.2. Support

Support 2 was coated on both sides with a second subbing layer at a coverage of 30 $m^2$ per liter coating solution. The coating solution was applied at 40° C. The layer was dried in a hot air stream at 130° C. during 2 minutes, resulting in the following layer composition per $m^2$ and per side:

- 0.19 g of gelatin (Koepff),
- 0.17 g of Kieselsol 100F (Bayer AG),
- 0.001 g of polymethylmethacrylate particles with an average diameter of 2.5 μm as a matting agent,
- 0.007 g of Ultrayon W (Ciba Geigy) and 0.003 g of Arkopal N060 (Hoechst AG) as coating aids.

1.1.3. Support 3

Support 3 was coated similar as support 2 except for the fact that part of the gelatin was replaced by a gelatinous dispersion of dye I. Per $m^2$ and per side 0.19 g of gelatin and 0.05 g of dye I were coated. For the preparation of the dispersion of dye I 100 g of dye I was dispersed at 40° C. and at a pH value of 5.5 in 900 g of an aqueous gelatin solution, containing 50 g of gelatin, by using a rotating pearl mill containing as a milling material zirconium oxide pearls sizing 1.0 to 1.6 mm. At a dye particle size of 1 μm the milling process was stopped, the dispersion was separated from the milling material and chilled.

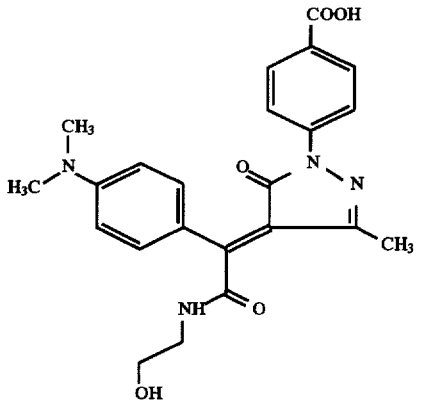

1.1.4. Support 4

Support 4 is similar to support 3, except for a doubling of the quantity of dye dispersion. Per $m^2$ and per side 0.19 g of gelatin and 0.1 g of dye I were coated.

1.1.5. Support 5

Support 5 is similar to support 4, except for a further doubling of the quantity of the dye dispersion. Per $m^2$ and per side 0.19 g of gelatin and 0.2 g of dye I were coated.

1.1.6. Support 6

Support 6 is similar to support 4, except for an increase of the amount of gelatin. Per $m^2$ and per side 0.5 g of gelatin and 0.1 g of dye I were coated.

1.2. Preparation of the Coating Solution of the Emulsion Layer 1.2.1. Emulsion Preparation.

A tabular silver bromoiodide emulsion, containing 1 mole % of AgI and 99 mole % of AgBr, was precipitated using the double jet technique. The excess $KNO_3$ was removed by the flocculation and washing technique after precipitation. The thus obtained tabular grain emulsion, containing 75 grams of gelatin pro mole of $AgNO_3$, had the following characteristics:

mean diameter of the circle with the same projective surface of the tabular grain: 1.12+/−0.23 μm (0.23 being the standard variation s).

mean thickness of the tabular grains: 0.23 μm.

aspect-ratio: 5.5.

percentage of total projective surface covered by the tabular grains: 98%.

1.2.2. Chemical Sensitization.

This emulsion was chemically sensitized in the presence of anhydro-5,5'-dichloro-3,3'-bis(n.sulfobutyl)-9-ethyloxacarbocyanine hydroxide, chloro auric acid, sodium thiosulphate and potassium thiocyanate in order to get an optimized fog-sensitivity relationship.

1.2.3. Additional Ingredients of the Emulsion Solution.

Per mole of $AgNO_3$ the following ingredients were added to the emulsion at 40° C.: 0.29 g of 4-hydroxy-6-methyl-1, 3,3a,7-tetraazaindene; 9.1 g of sorbitol; 14.5 g of polyethylacrylate (MW=1000000); 3.05 g of 1,3- dihydroxybenzene; 31 g of dextrane (MW=10000); 10 g of gelatin and demineralised water in an amount necessary to get the desired wet coating thickness.

1.3. Preparation of the Coating Solution of the Protective Layer:

To 800 ml of demineralized water the following ingredients were added: 44 g of gelatin; 0.92 g of polymethylmethacrylate (average particle diameter: 3.5 μm); 0.3 g of ammoniumperfluorocaprylate; 0.752 g of $C_{17}H_{15}$—CO—NH—$(CH_2$—$CH_2$—O—$)_{17}$—H and 4 g of formaldehyde. Demineralized water was added to get the desired wet coating thickness and gelatine per $m^2$.

1.4. Coating of the Materials 1 to 5 (Comparative Coatings)

Materials 1 to 5 were obtained by coating simultaneously the emulsion layer and the protective layer at both sides of the supports 2 to 6 making use of the coating solutions for the emulsion and protective layer, held at 38° C., the composition of which has been described hereinbefore, and dried under controlled humidity and temperature conditions, never exceeding a temperature of 30° C. The emulsion and protective layer were coated simultaneously by means of the slide hopper technique with the protective layer on top. Before drying the thicknesses of the emulsion layer and protective layer were 44 and 25 μm respectively. Per $m^2$ and per side the emulsion layer was containing 3.75 g of silver, expressed as the equivalent amount of silver nitrate and 1.87 g of gelatin. The protective antistress layer was containing 1.1 g of gelatin.

1.5. Coating of the Materials 6 and 7 (Invention).

1.5.1. Material 6 (Invention).

Preparation of the coating solution containing the dye I. To 500 ml of demineralised water 100 g of the above described dye dispersion and 10 g of gelatin were added at 40° C. and at a pH value of 5.5. Demineralized water was added to obtain an end volume of one liter. Material 6 was obtained by coating simultaneously on both sides of support 1 the solution containing dye I, the above described solutions for the emulsion and protective layer. The temperature of the solutions before coating was 38° C. The layer containing dye I was in contact with the support, whereas the protective layer was on top of the material. The coating procedure was performed by means of the slide hopper technique. The wet coating thicknesses of the dye layer (also called antihalation layer). the emulsion layer and the protective layer were 10, 44 and 25 μm respectively. Per $m^2$ and per side the antihalation layer was containing 0.19 g of gelatin and 0.100 g of dye I, the emulsion layer was containing 3.75 g of silver, expressed as the equivalent amount of silver nitrate and 1.87 g of gelatin and the protective topcoat layer was containing 1.1 g of gelatin.

After coating, the layers were dried under controlled conditions of humidity and temperature (never exceeding 30° C.).

1.5.2. Material 7 (Invention).

Material 7 is similar to material 6 except for the solution containing dye I which was prepared with 200 g of the dispersion of dye I and 9.0 g of gelatin. After drying the said layer was containing per $m^2$ and per side: 0.19 g gelatin and 0.20 g dye I.

2. Evaluation Procedures.

2.1. Processing Conditions.

To evaluate the photographic performance, dye stain and drying characteristics, samples of the materials were processed: A CURIX HT530 (Agfa-Gevaert trademarked name) processor was used with the following processing time (in seconds) and processing temperature (in °C.) characteristics:

| function: | time | temperature | condition |
|---|---|---|---|
| loading: | 0.2 | | |
| developing: | 11.5 | 35° C. | developer described below |
| cross-over: | 1.7 | | |

-continued

| function: | time | temperature | condition |
|---|---|---|---|
| rinsing: | 1.1 | | |
| cross-over: | 1.8 | | |
| fixing: | 8.2 | 35° C. | fixer described below |
| cross-over: | 2.5 | | |
| rinsing: | 5.4 | 20° C. | |
| cross-over: | 5.8 | | |
| drying: | 8.3 | | |
| total: | 46.5 | | |

Composition of Developer:

Composition of the concentrated part: water: 200 ml; potassium bromide: 12 g; potassium sulphite (65% solution): 249 g; ethylenediaminetetraacetic acid, sodium salt, trihydrate: 9.6 g: hydroquinone: 106 g; 5-methylbenzotriazole: 0.076 g; 1-phenyl-5-mercaptotetrazole: 0.040 g; sodiumtetraborate (decahydrate): 70 g; potassium carbonate: 38 g; potassium hydroxide: 49 g; diethylene glycol: 111 g; potassium iodide: 0.03 g; 4-hydroxymethyl-4methyl-1phenyl-3-pyrazolidinone: 8.15 g; water to make 1 liter. The pH was adjusted to 11.15 at 25° C. with potassium hydroxide.

For initiation of the processing one part of the concentrated developer was mixed with 3 parts of water. The pH of this mixture was 10.30 at 25° C.

Composition of the Fixer:

Composition of the concentrated part: ammonium thiosulfate (78% solution): 661 g; sodium sulphite: 54 g; boric acid: 25 g; sodium acetate-trihydrate: 70 g; acetic acid: 40 g and water to make 1 liter. The pH was adjusted with acetic acid to 5.30 at 25° C.

To make this fixer ready for use one part of this concentrated part was mixed with 4 parts of water. A pH of 5.25 was measured at 25° C.

2.2. Determination of the Cross-Over (% CO).

Samples of the materials were placed between a single green light emitting screen (CURIX ortho Regular: Agfa-Gevaert trade name) and a white paper, replacing the second screen. This film-screen element, directed with its light emitting screen to the X-ray tube, was then exposed with varying X-ray doses, expressed as log E. After processing these samples in the above described processing cycle, the minimal dose (log E) needed to obtain a density of 0.5 above fog was determined for the front layer (log E front) and the back layer (log E back) separately. The cross-over (% C.O.) was then calculated according to the following equation:

$$\% CO = 100/antilog\ (logE\ back - logE\ front)$$

2.3. Measurement of Residual Dye (Dye Stain).

Unexposed samples of the materials were processed under the above described processing condition and evaluated for dye stain.

As a result none of the samples showed a significant dye stain.

2.4. Measurement of the Swelling Degree.

After incubating a sample of each material at 57° C. and 34% RH for 3 days, the thickness (a) of the layer assemblage was measured. Thereafter the sample was immersed in distilled water at 21° C. for 3 minutes and the thickness (b) of the swollen layer was measured.

The swelling ratio is then calculated as: (b-a)/a×100 (%).

The thickness of the layers, whether dry or swollen, was measured using a stamper moving up and down with respect to the surface of the sample. The surface of the stamper contacting the surface of the sample was curved with a curvature radius of 17 mm. The weight that the stamper exerted on the sample is 6 g. The stamper thereby moved through a spool causing an induction current which was proportional to the thickness of the sample. The stamper was first callibrated using a sample of known thickness.

As a result the swelling ratio of the materials were all between 170 and 190%.

2.5. Measurement of the Drying Capacity.

5 unexposed sheets (14"×17") of each of the materials were processed one after another directly in the above described processing condition. The fifth sheet was evaluated, whether it is dry or wet, immediately after processing.

2.6. Measurement of Adhesion Property.

Samples of the materials were dipped for 4 minutes into water of 25° C., whereupon the layer arrangement was scratched cross-wise with a pen tip reaching the film base.

The adhesion in wet stage was checked by rubbing the wetted layer arrangement with finger tip for 10 seconds.

The quality of the wet adhesion was evaluated by giving the result of the rubbing a rating from 0 to 4, wherein 0 stands for non-removal and 4 for complete removal by said rubbing.

In Table I the dye layer which was dried at 130° C. separately from the emulsion layer and from the protective layer is called "DLA", referring to the comparative materials. Opposite thereto the dye containing layer which was coated simultaneously with the emulsion layer and the protective layer is called "DLB", referring to the materials prepared according to this invention. For the DLA and DLB layers the amounts of gelatin and of dye, expressed in g per $m^2$ and per side, are given in Table I.

TABLE I

| Material | DLA dye | DLA gelatin | DLB dye | DLB gelatin | % CO | Drying | Adhesion |
|---|---|---|---|---|---|---|---|
| 1(comp.) | 0 | 0.19 | 0 | 0 | 38 | dry | 0 |
| 2(comp.) | 0.05 | 0.19 | 0 | 0 | 15 | dry | 0 |
| 3(comp.) | 0.10 | 0.19 | 0 | 0 | 10 | dry | 3 |
| 4(comp.) | 0.20 | 0.19 | 0 | 0 | 4 | dry | 4 |
| 5(comp.) | 0.10 | 0.50 | 0 | 0 | 10 | wet | 0 |
| 6(inv.) | 0 | 0 | 0.10 | 0.19 | 10 | dry | 0 |
| 7(inv.) | 0 | 0 | 0.20 | 0.19 | 4 | dry | 0 |

The above table shows that in the comparative materials an increase of the amount of dye which is favourable for reducing crossover, results in adhesion problems (comp. 3 and 4 with a ratio by weight of dye to gelatin of 0.53 and 1.05 respectively).

The latter problem can be avoided by increasing also the amount of gelatin (comp. 5: ratio by weight of dye to gelatin of 0.20) but then the drying capacity becomes too low.

When the dye containing layer is coated simultaneously with the emulsion and the protective layer a higher ratio by weight of dye to gelatin can be reached and even without increasing the gelatin content the material is good both for drying and for adhesion, contrary to the comparative materials (inv. 6 and 7 with a similar ratio by weight of dye to gelatin as comp. 3 and 4 respectively).

As a consequence a crossover percentage of less than 15 % is obtained for materials prepared according to the method of this invention, compared with comparative materials having comparable physical characterisitics.

I claim:

1. Method to provide a radiographic silver halide material by coating in consecutive order on at least one side of a support, covered with a hydrophobic subbing layer comprising as a latex copolymer vinylidene chloride, methylacrylate and itaconic acid following hydrophilic layers:

at least one gelatinous dye containing layer comprising one or more dyes wherein the said dye(s) is(are) present in a total amount of not more than 300 mg/m$^2$ in an amount of hydrophilic binder such that the ratio by weight of dye to gelatin is between 0.4 and 1.3, at least one silver halide emulsion layer, at least one protective antistress layer, characterized in that said hydrophilic layers have a swelling ratio of not more than 200% and in that said hydrophilic layers are coated simultaneously by the slide-hopper coating or by the slide-hopper curtain coating technique.

2. Method according to claim 1, wherein as an outermost hydrophilic layer an afterlayer is present.

3. Method according to claim 1, wherein the said dye(s) is (are) selected from the group consisting of an oxonol and/or a merostyryl dye that is soluble in processing solutions at a pH of at least 8.0 and being insoluble at a pH lower than 6.0.

4. Method according to claim 1, wherein the said dye(s) is(are) present in the form of a microprecipitated dispersion.

5. Method according to claim 1, wherein there are two dye containing layers: a first layer containing at least one dye and adjacent thereto a second layer containing at least one dye, which may be the same or different than the dye in the first layer.

6. Method according to claim 5 wherein the dye(s) in the first layer is(are) present in an amount of not more than 100 mg/m$^2$.

7. Method according to claim 1, wherein the said silver halide emulsion layer(s) contain at least one tabular silver halide emulsion.

8. Method according to claim 1 wherein the said hydrophilic layers are hardened by formaldehyde.

* * * * *